US007294800B2

(12) United States Patent
Koyama

(10) Patent No.: US 7,294,800 B2
(45) Date of Patent: Nov. 13, 2007

(54) SWITCHING DEVICE

(75) Inventor: Katsuya Koyama, Aisai (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 11/386,453

(22) Filed: Mar. 22, 2006

(65) Prior Publication Data

US 2006/0283696 A1 Dec. 21, 2006

(30) Foreign Application Priority Data

Jun. 17, 2005 (JP) ..... 2005-178482

(51) Int. Cl.
*H01H 9/00* (2006.01)

(52) U.S. Cl. ..... 200/302.1; 200/302.3

(58) Field of Classification Search ..... 200/1 R, 200/1 B, 4, 5 R, 6 R, 17 R, 18, 557, 558, 200/572, 339, 302.1, 302.3, 293
See application file for complete search history.

(56) References Cited

U.S. PATENT DOCUMENTS

| | | | | |
|---|---|---|---|---|
| 5,117,074 | A * | 5/1992 | Yanai et al. | 200/302.3 |
| 5,414,231 | A * | 5/1995 | Sato et al. | 200/1 R |
| 5,468,926 | A * | 11/1995 | Sato | 200/558 |
| 5,647,478 | A | 7/1997 | Hirai | |
| 5,824,981 | A * | 10/1998 | Suzuki | 200/302.1 |
| 5,876,243 | A | 3/1999 | Sangawa et al. | |
| 6,444,930 | B1 * | 9/2002 | MacDonald et al. | 200/302.3 |
| 6,911,612 | B2 * | 6/2005 | Seki | 200/339 |
| 7,071,435 | B2 * | 7/2006 | Altmann | 200/339 |

FOREIGN PATENT DOCUMENTS

| | | |
|---|---|---|
| EP | 0 633 586 | 1/1995 |
| JP | 5-314864 | 11/1993 |
| JP | 9-204842 | 8/1997 |
| JP | 11-86662 | 3/1999 |
| JP | 2004-319539 | 11/2004 |

OTHER PUBLICATIONS

European Search Report dated Oct. 27, 2006; Application No. EP06004656.2 (5 pages).

espEcenet document Abstract of EP0633586 (1 page).

Patent Abstracts of Japan, Publication No. 05-314864, Publication Date: Nov. 26, 1993, 1 page.

Patent Abstracts of Japan, Publication No. 11-086662, Publication Date: Mar. 30, 1999, 1 page.

Japanese Office Action for Japanese Patent Application No. 2005-178482, issued May 10, 2007, and English translation thereof, 6 pages.

* cited by examiner

*Primary Examiner*—Michael A Friedhofer
(74) *Attorney, Agent, or Firm*—Osha Liang LLP

(57) ABSTRACT

A switching device capable of preventing entrance of water from outside of a case through a space below an operation knob into the case is disclosed. The switching device includes: a switch; a case within which the switch is accommodated; a hollow cylinder which is formed integrally with the upper surface of the case and open to above and below to communicate with the inside of the case; an operation knob provided to cover an upper opening of the cylinder such that the operation knob can swing; and an operation bar which extends through a lower opening of the cylinder into the case to transmit the motion of the operation knob to the switch. A concave is formed on the upper surface of the case at a position around the cylinder. A lid for covering a part of the concave is provided on the concave near the cylinder.

3 Claims, 7 Drawing Sheets

SWITCHING DEVICE

BACKGROUND OF THE INVENTION

1. Field of the Invention

The present invention relates to a switching device for switching on and off by operation of an operation knob which swings, and more particularly to a waterproof-type switching device capable of preventing water from entering into its case.

2. Description of Related Art

FIG. 6 is a side view schematically showing a structure of a conventional switching device 50 used in a window open/close system (power window system) of a vehicle. The switching device 50 has a case 51, and switches, a circuit board and other components which will be described later are accommodated inside the case 51. A seesaw-motion type operation knob 56 of a window open/close switch is operated to open and close a window of the vehicle. The operation knob 56 has an operation section 56*a*, a cap section 56*b* formed integrally with the operation section 56*a*, and holes 56*c* formed on the side walls of the cap section 56*b*. A cylinder 57 is provided on an upper surface 51*e* of the case 51, and a shaft 57*a* is formed integrally with the outer wall of the cylinder 57. The cap section 56*b* of the operation knob 56 is attached to the cylinder 57 from above, and the holes 56*c* of the operation knob 56 are brought into engagement with the shaft 57*a* of the cylinder 57. By this engagement, the operation knob 56 is supported by the cylinder 57 such that the operation knob 56 can swing around the shaft 57*a*. An operation knob 54 is a push-lock-type operation knob of a window lock switch, and is operated to lock the windows of the vehicle such that the windows cannot be opened, and to release the lock. The switching device 50 is attached to an arm rest (not shown) provided on the door of the driver's seat of the vehicle, and is covered by a cover 61 shown in FIG. 7 in areas other than the positions of the operation knobs 54 and 56.

FIG. 7 is a cross-sectional view showing a main part of the switching device 50 to which the cover 61 is attached. As apparent from the figure, the cylinder 57 is a hollow cylinder which is open to above and below to communicate with the inside of the case 51. A circuit board 64 is provided inside the case 51, and a switch 63 is packaged on the circuit board 64. The switch 63 is a switch for opening and closing a window, and is formed by a known slide switch. The switch 63 has an actuator 63*a*. An operation bar 62 connected to the operation knob 56 extends through a lower opening 57*c* of the cylinder 57 toward the inside of the case 51. A concave 62*a* is formed at the lower end of the operation bar 62. By engagement between the concave 62*a* and the actuator 63*a* of the switch 63, the motion of the operation knob 56 is transmitted through the operation bar 62 to the switch 63, and contacts equipped inside the switch 63 are switched between on and off in accordance with the operating position of the operation knob 56. A point Q is the rotation center of the operation knob 56, and corresponds to the position of the shaft 57*a* shown in FIG. 6. An opening 61*a* through which the finger is inserted to operate the operation section 56*a* of the operation knob 56 is formed on the cover 61. The operation section 56*a* is exposed through the opening 61*a*.

A switching device having a similar structure as that of the switching device 50 explained above is shown in JP-A-8-180755 and JP-A-5-314864 (Patent References 1 and 2). JP-A-11-86662 (Patent Reference 3) discloses a switching device which is waterproofed by surrounding soldered portions of electronic component terminals on a circuit board with side walls formed by rubber contact members without requiring coatings.

In the switching device 50 described above, the opening 61*a* of the cover 61 is sized large enough to prevent any trouble which may be caused when putting the finger on the operation section 56*a* of the operation knob 56 to lower or raise the operation section 56*a*. As a result, raindrops entering through the window which has been left open, beverage accidentally spilt in the vehicle compartment or the like (hereinafter collectively referred to as "water") may flow through the opening 61*a* into a concave 61*b* as illustrated in FIG. 7. In this case, when a large amount of water flows into the concave 61*b*, the water entering the concave 61*b* flows through a clearance 65 formed between a bottom wall 61*f* of the concave 61*b* and the cap section 56*b* of the operation knob 56 and rises through a clearance 66 formed between the cap section 56*b* of the operation knob 56 and a side wall 57*e* of the cylinder 57. Then, the water enters through an upper opening 57*b* of the cylinder 57 into the cylinder 57, and flows through the lower opening 57*c* of the cylinder 57 into the case 51 as shown by arrows in FIG. 7.

Nothing is described about prevention of water which enters from below the operation knob 56 as in the manner explained above in Patent References 1 and 2 mentioned above. Additionally, while Patent Reference 3 discloses a waterproofing technique for preventing short-circuit, entrance of water from below the operation knob into the case cannot be prevented in such a switching device which does not use rubber contacts according to the technique shown in this reference.

SUMMARY OF THE INVENTION

Accordingly, it is an object of the invention to provide a switching device capable of preventing water from entering from outside of a case through a space below an operation knob into the case.

A switching device according to the invention includes: a switch; a case within which the switch is accommodated; a cylinder which is provided on the upper surface of the case and open to above and below to communicate with the inside of the case; an operation knob provided to cover the opening of the cylinder such that the operation knob can swing; and an operation bar which extends from the operation knob through the opening of the cylinder into the case to transmit the motion of the operation knob to the switch. A concave is formed on the upper surface of the case in the vicinity of the cylinder. A lid for covering a part of the concave is provided on the concave near the cylinder.

In this structure, when water flows from the outside of the case toward a space below the operation knob, the water enters into the concave and the lid prevents the water from rising from the concave toward a clearance between the operation knob and the cylinder. Thus, entrance of water through the opening of the cylinder into the case can be prevented.

According to the invention, it is preferable that the position of an end of the lid on the side opposite to the cylinder is closer to the cylinder than the position of the end of the operation knob.

In this structure, water flows into the concave without rising along the upper surface of the lid toward the cylinder. Accordingly, entrance of water through the clearance between the operation knob and the cylinder into the case can be more securely prevented.

According to the invention, when water flows from the outside of a case toward a space below an operation knob, the water enters into a concave and a lid prevents the water from rising from the concave toward a clearance between the operation knob and a cylinder. Thus, entrance of water through the opening of the cylinder into the case can be prevented.

DESCRIPTION OF PREFERRED EMBODIMENTS

Figure 1:
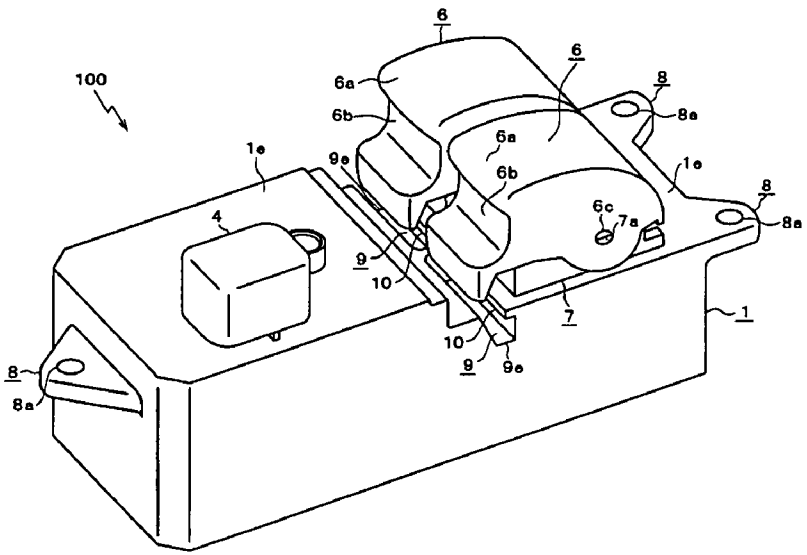
FIG. 1 illustrates an external appearance of a switching device according to an embodiment of the invention.

An embodiment according to the invention is hereinafter described with reference to FIGS. 1 through 5. In these figures, similar reference numerals are given to similar components.

Figure 3:
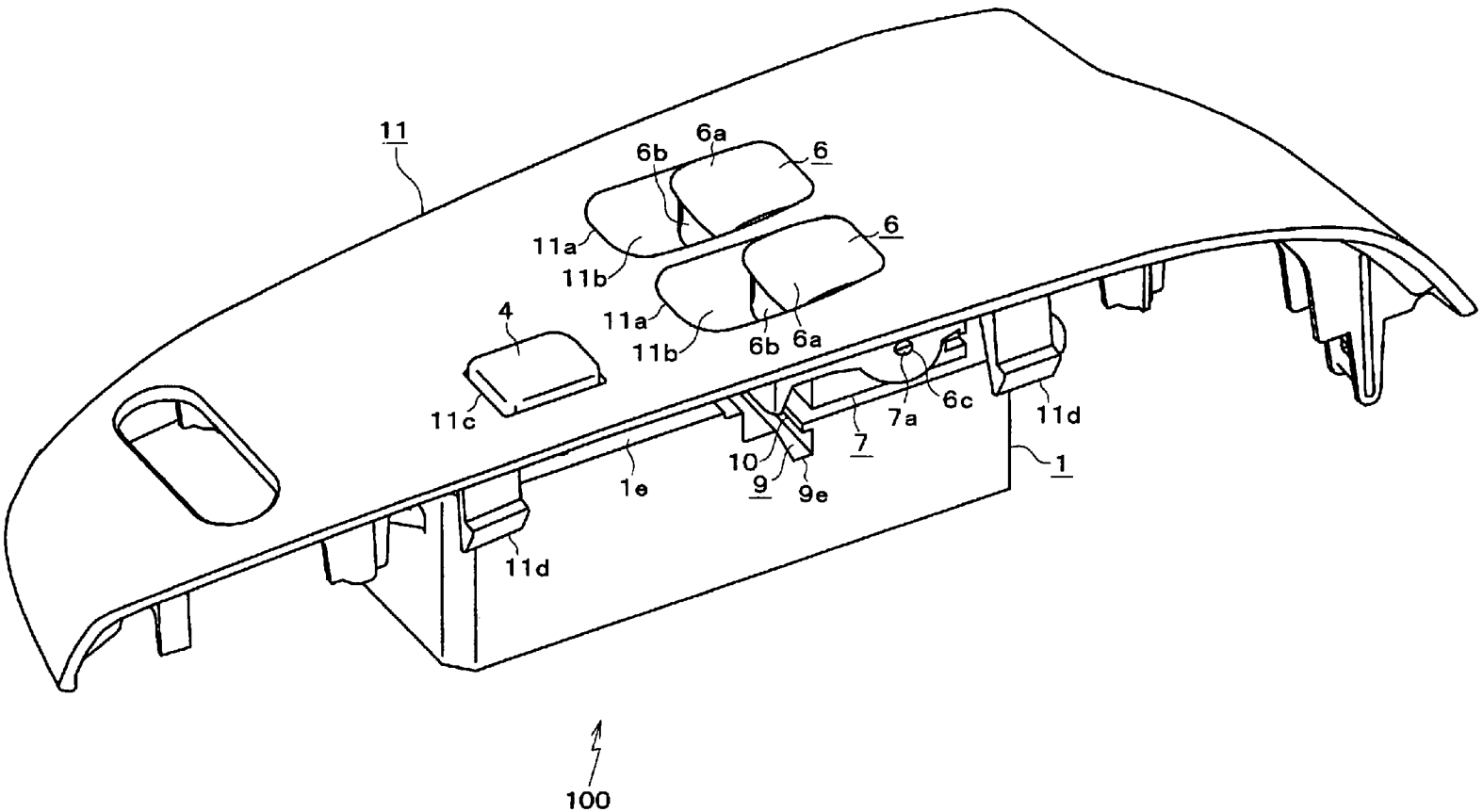
FIG. 3 illustrates an external appearance of the switching device to which a cover is attached.

FIG. 1 illustrates an external appearance of an example of a switching device 100 used in a power window system. The switching device 100 has a case 1, and components such as switches and a circuit board which will be described later are accommodated inside the case 1. The bottom of the case 1 is opened, and a not-shown lower cover closes this area by engagement therewith. An attachment flange 8 is provided on each of the front surface and rear surface of the case 1, and a cover 11 shown in FIG. 3 is attached to the case 1 using those flanges 8. A hole 8*a* is formed on each of the attachment flanges 8.

An operation knob 4 is a push-lock-type operation knob of a window lock switch, and is operated to lock the windows of the vehicle such that the windows cannot be opened or closed, and to release the lock. Two seesaw-motion type operation knobs 6 of window open/close switches are operated to open or close the windows of the vehicle. Each of the operation knobs 6 has an operation section 6*a*, a cap section 6*b* formed integrally with the operation section 6*a*, and holes 6*c* formed on the side walls of the cap section 6*b*. While one hole 6*c* on each operation knob 6 is shown in FIG. 1, the same hole as the hole 6*c* is actually formed on the side wall opposite to the side wall where the hole 6*c* is shown.

Figure 2:
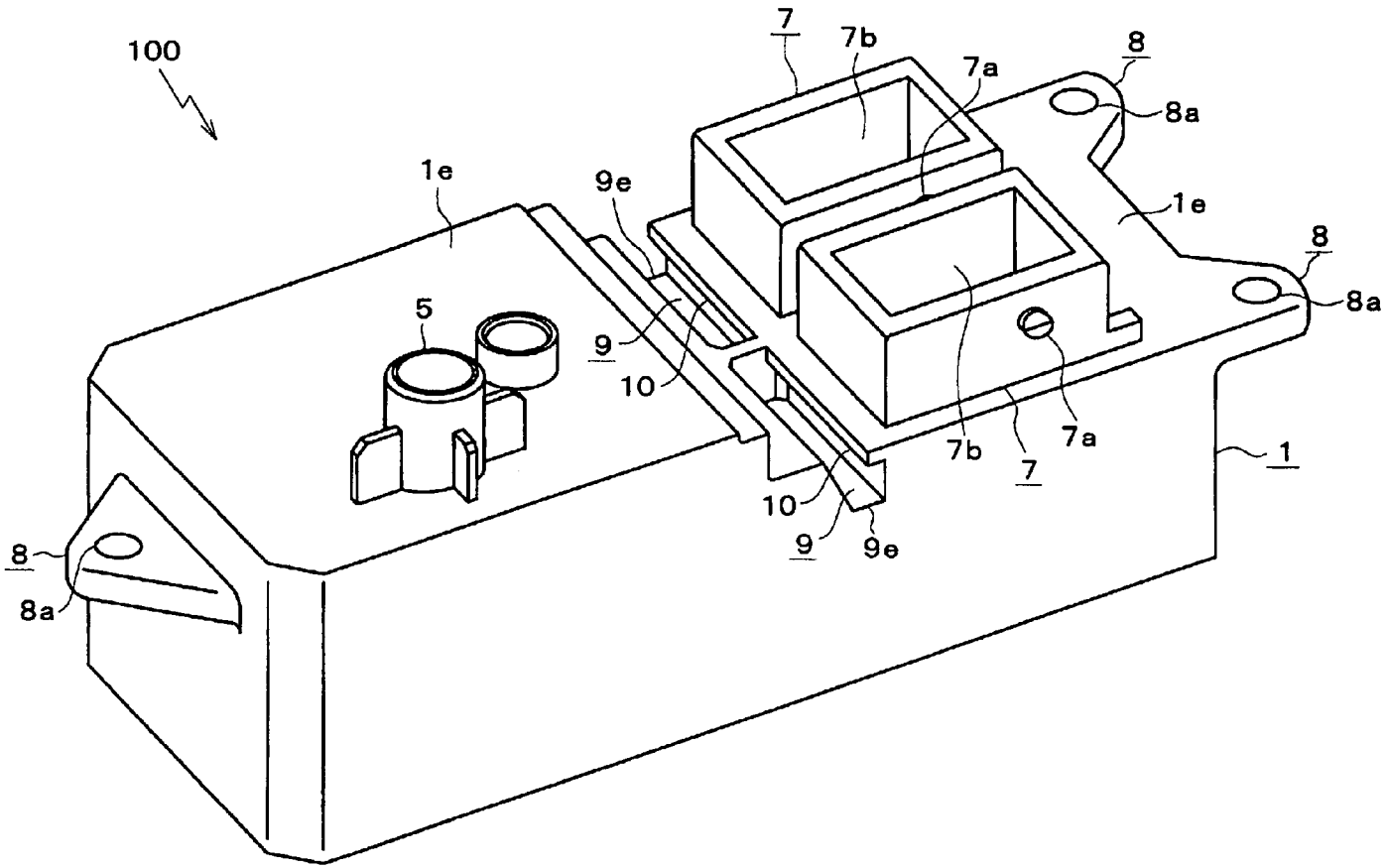
FIG. 2 illustrates an external appearance of the switching device from which operation knobs are removed.

FIG. 2 illustrates an external appearance of the switching device 100 in FIG. 1 from which the operation knobs 4 and 6 are removed. Cylinders 7, to which the operation knobs 6 shown in FIG. 1 are attached, are provided on an upper surface 1*e* of the case 1. Shafts 7*a* are formed integrally with the outer walls of each cylinder 7. The cylinders 7 are open to above, forming upper openings 7*b*. The shape of the horizontal cross section of the cylinders 7 is substantially rectangular in this embodiment, but the horizontal cross section of the cylinders 7 may have circular or other shapes. In FIG. 2, the cap sections 6*b* of the operation knobs 6 shown in FIG. 1 are attached to the cylinders 7 from above to cover the upper openings 7*b* of the cylinders 7, and the holes 6*c* of the operation knobs 6 are brought into engagement with the shafts 7*a* of the cylinders 7. By this engagement, the operation knobs 6 are supported by the cylinders 7 such that the operation knobs 6 can swing around the shafts 7*a*. The operation knob 4 provided on the upper surface 1*e* of the case 1 shown in FIG. 1 is attached to a cylinder 5.

Concaves 9 are formed on the upper surface 1*e* of the case 1 in the vicinity of certain parts (front parts) of the cylinders 7. The concaves 9 have a width slightly larger than the width of the operation knobs 6, and extend in the width direction of the case 1 to open at the sides of the case 1, forming ends 9*e*. Lids 10 projecting to the front are formed on the concaves 9 near the cylinders 7. The lids 10 are formed by eave-shaped projections for covering some parts of the concaves 9. The details of these components will be described later.

FIG. 3 illustrates an external appearance of the switching device 100 shown in FIG. 1 to which the cover 11 is attached. The cover 11 covers the switching device 100 in areas other than the positions of the operation knobs 4 and 6 when the switching device 100 is attached to an arm rest (not shown) provided on the door of the driver's seat of the vehicle. Hook pieces 11*d* are used to attach the cover 11 to the arm rest. Bosses (not shown) having screw holes at their distal ends are provided on the back surface of the cover 11 at the positions corresponding to the attachment flanges 8 of the case 1 shown in FIG. 1. For attaching the cover 11 to the case 1, screws (not shown) are inserted through the holes 8*a* of the respective attachment flanges 8 with the respective bosses contacting the attachment flanges 8 to bring the screws into engagement with the screw holes of the bosses.

Two openings 11*a* through which the finger is inserted for operating the operation sections 6*a* of the operation knobs 6 are formed approximately in the middle part of the cover 11. The operation sections 6*a* are thus exposed through the respective openings 11*a*. An opening 11*c* through which the operation knob 4 is exposed is also formed. Since the operation knob 4 can be operated only by pushing from above, the opening area of the opening 11*c* is small. However, since the operation knobs 6 are lowered or raised with the finger put on the operation sections 6*a*, the opening areas of the openings 11*a* are large. Concaves 11*b* for accommodating the operation knobs 6 and the cylinders 7 are formed below the openings 11*a*.

Figure 4:
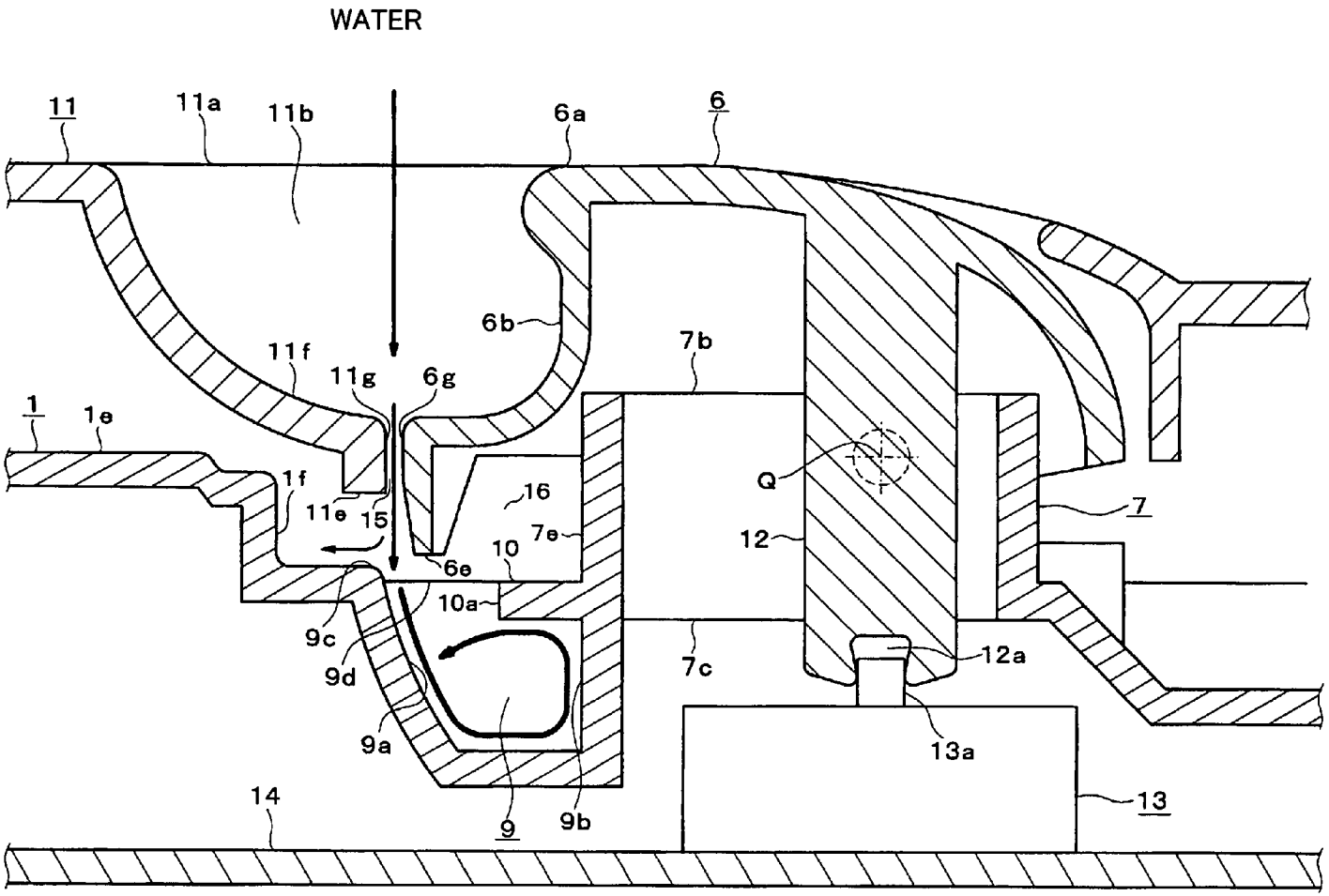
FIG. 4 is a cross-sectional view showing a main part of the switching device to which the cover is attached.
Figure 5:
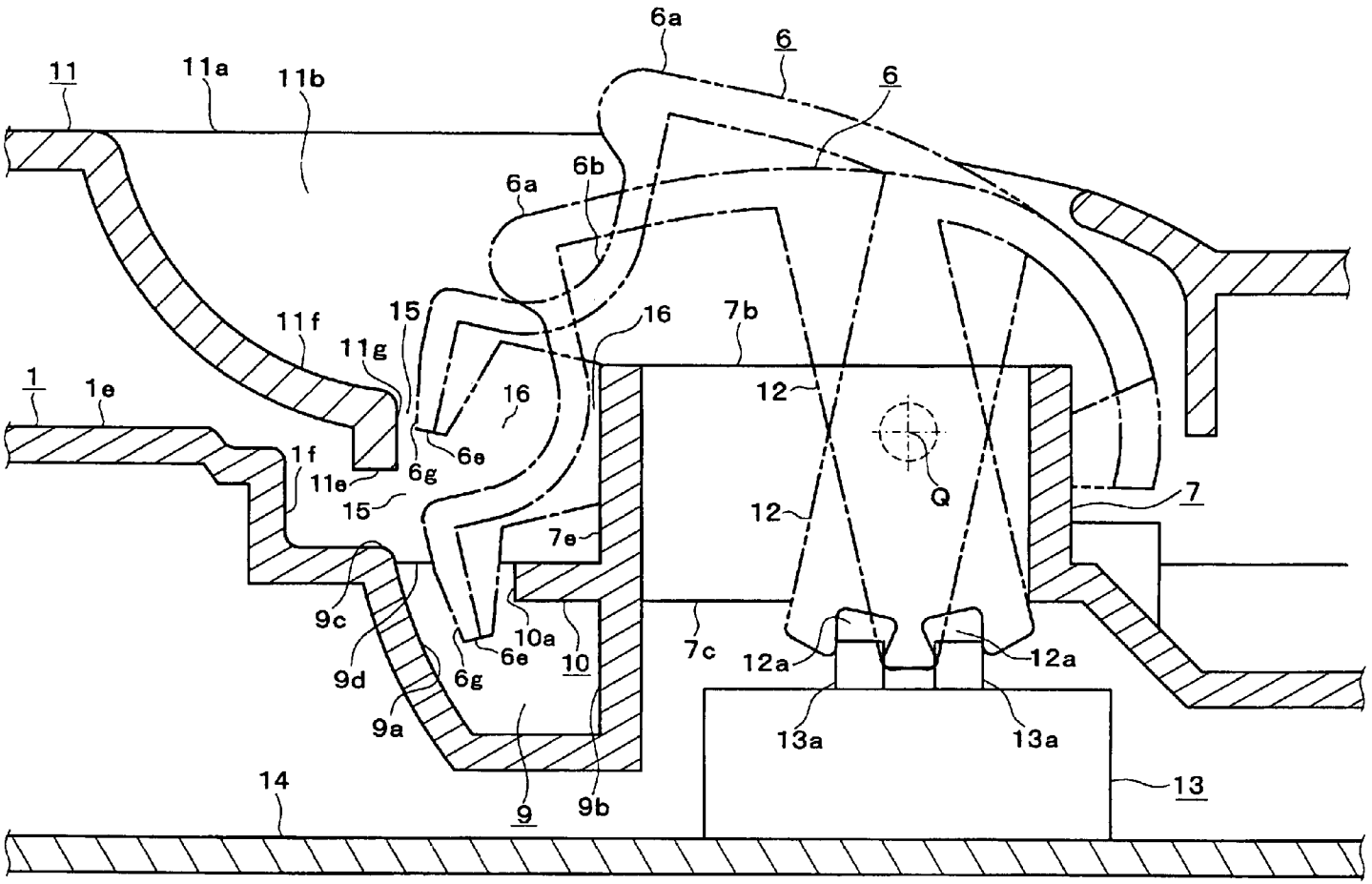
FIG. 5 is a cross-sectional view showing a main part of the switching device in a condition where the operation knob is shifted.
Figure 6:
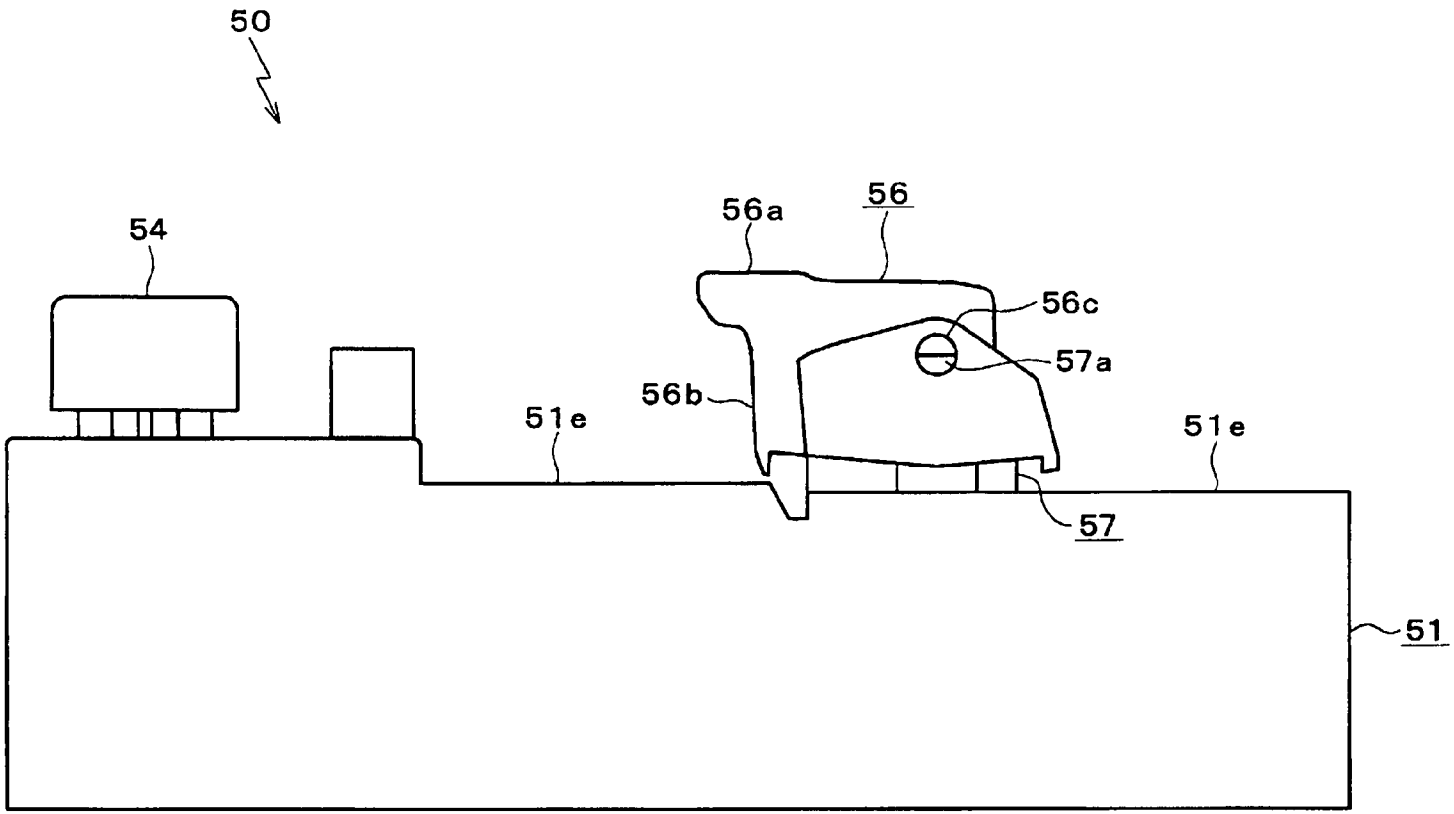
FIG. 6 is a side view schematically showing a structure of a conventional switching device.
Figure 7:
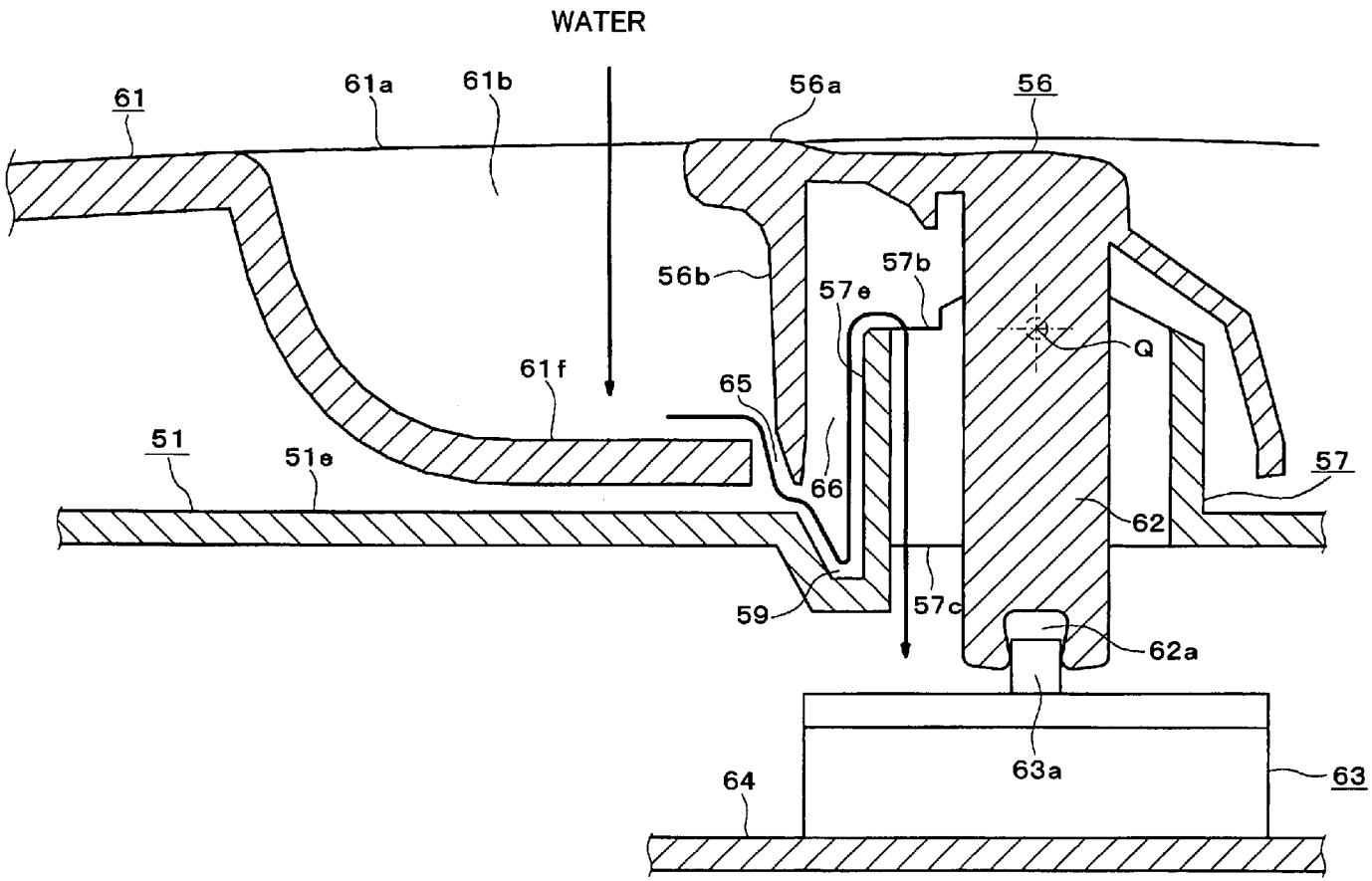
FIG. 7 is a cross-sectional view of a main part of the switching device shown in FIG. 6 to which a cover is attached.

FIG. 4 is a cross-sectional view showing a main part of the switching device 100 to which the cover 11 is attached. As apparent from the figure, the cylinder 7 is a hollow cylinder which opens to above and below to communicate with the inside of the case 1. A circuit board 14 is provided within the case 1, and a switch 13 is packaged on the circuit board 14. The switch 13 is a switch for opening and closing a window, and is formed by a known slide switch. The switch 13 has an actuator 13*a*. An operation bar 12 connected to the operation knob 6 extends through a lower opening 7*c* of the cylinder 7 toward the inside of the case 1. A concave 12*a* is formed at the lower end of the operation bar 12. By engagement between the concave 12*a* and the actuator 13*a* of the switch 13, the motion of the operation knob 6 is transmitted through the operation bar 12 to the switch 13, and contacts equipped inside the switch 13 are switched between on and off in accordance with the operating position of the operation knob 6. A point Q is the rotation center of the operation knob 6, and corresponds to the position of the shaft 7*a* shown in FIG. 1.

A side 9*a* of the concave 9 on the side opposite to the cylinder 7 is inclined downward in the direction toward the cylinder 7. The side 9*b* on the cylinder 7 side is disposed in the same vertical plane as that of a front surface 7*e* of the cylinder 7. The position of an end 9*c* of the concave 9 on the side opposite to the cylinder 7 is at a greater distance away from the cylinder 7 than the positions of a front end 6*g* of the cap section 6*b* of the operation knob 6 and an end 11*g* of a bottom wall 11*f* of the cover 11 opposed to the front end 6*g* with a clearance 15 interposed therebetween. The position of an end 10*a* of the lid 10 on the side opposite to the cylinder 7 is closer to the cylinder 7 than the positions of the end 11*g* of the cover 11 and the front end 6*g* of the operation knob 6. Thus, an opening 9*d* of the concave 9 not covered by the lid 10 and the slope 9*a* are located immediately below the clearance 15.

FIG. 4 shows a condition where the operation knob 6 is not shifted, that is, the operation knob 6 is in the neutral position. In this condition, the lower end 6*e* of the cap section 6*b* of the operation knob 6 is positioned between the lower end 11*e* of the cover 11 and the lid 10. When the operation section 6*a* is lowered to shift the operation knob 6 anticlockwise as shown by alternate long and short dash lines in FIG. 5 for opening the window, the lower end 6*e* of the operation knob 6 moves away from the lower end 11*e* of the cover 11 and enters the concave 9, reaching a position below the lid 10. The slope 9*a* of the concave 9 is curved with predetermined curvature substantially in parallel with a track defined by the front end 6*g* of the operation knob 6 when the operation knob 6 is shifted. When the operation section 6*a* is raised to shift the operation knob 6 clockwise as shown by alternate long and two short dashes lines in FIG. 5 for closing the window, the lower end 6*e* of the operation knob 6 moves away from the lid 10, reaching a position above the lower end 11*e* of the cover 11. The clearance 15 between the front end 6*g* of the operation knob 6 and the end 11*g* of the cover 11 is so sized that no trouble is caused for the swinging motions in both the directions discussed above, i.e., that the operation knob 6 and the cover 11 do not contact each other at the time of swinging motions in both the directions.

When the operation knob 6 is at the neutral position as shown in FIG. 4, the clearance 15 becomes the minimum and has a constant width throughout the entire length in the vertical direction. When the operation knob 6 is shifted clockwise as shown by the alternate long and two short dashes lines in FIG. 5, the clearance 15 slightly increases toward above. When the operation knob 6 is shifted anticlockwise as shown by the alternate long and short dash lines in FIG. 5, the end 11*g* of the cover 11 and the front end 6*g* of the operation knob 6 vertically move away from each other and come to be not opposed thereto, making the clearance 15 considerably large.

In the switching device 100 having the above structure, when a large amount of raindrops entering through the window which has been left open, beverage accidentally spilt in the vehicle compartment or the like (hereinafter collectively referred to as "water") enters through the opening 11*a* of the cover 11 toward the concave 11*b*, the water flows out of the concave 11*b* through the clearance 15 as shown by arrows in FIG. 4. Then, most of the water flowing out enters through the opening 9*d* of the concave 9 positioned immediately below to the inside as shown by a bold arrow, and falls along the slope 9*a*. Thereafter, the water collides with the side 9*b* and rises therealong, and then collides with the lid 10 and flows toward the slope 9*a*. Thus, the water circulates in the concave 9 making swirls, and the rising flow of water flowing from the concave 9 and approaching a clearance 16 between the cylinder 7 and the operation knob 6 is blocked by the lid 10. Then, the water circulating in the concave 9 is discharged to the outside through the open end 9*e* (FIG. 1) of the concave 9 without rising toward above the lid 10. When a slope inclined downward in the direction toward the outside is formed at the bottom in the vicinity of the end 9*e* of the concave 9, the water in the concave 9 can be smoothly discharged along this slope.

An extremely small amount of water flowing out of the concave 11*b* flows in the direction opposite to the concave 9 as shown by a fine arrow. This water collides with a stepped wall 1*f* of the case 1 and splashes, and then enters into the concave 9 to be discharged to the outside as in the manner described above, or flows along the stepped wall 1*f* toward the side to be discharged from the end of the case 1 to the outside.

As described above, when water flows from the outside of the case 1 through the clearance 15 toward a space below the operation knob 6, the water enters into the concave 9 and the lid 10 prevents the water from rising from the concave 9 toward the clearance 16 between the operation knob 6 and the cylinder 7. Thus, entrance of water through the upper and lower openings 7*b* and 7*c* of the cylinder 7 into the case 1 can be prevented.

Since the position of the end 10*a* of the lid 10 is closer to the cylinder 7 than the position of the front end 6*g* of the operation knob 6, water flows into the concave without rising along the upper surface of the lid 10 toward the cylinder. Moreover, since the position of the end 9*c* of the concave 9 is at a greater distance away from the positions of the front end 6*g* of the operation knob 6 and the end 11*g* of the cover 11 on the side opposite to the cylinder 7, water directly enters from the clearance 15 into the concave 9. Accordingly, entrance of water through the clearance 16 between the operation knob 6 and the cylinder 7 into the case 1 can be more securely prevented.

In this embodiment, the concaves 9 are disposed on the upper surface 1*e* of the case 1 in the vicinity of certain parts (only front regions) of the cylinders 7. However, the invention is not limited to this structure. The concaves 9 may be provided near other portions of the cylinders 7, or may be formed on the entire circumferences of the cylinders.

In the respective embodiments described herein, the invention is applied to the switching device 100 used in the power window system. However, the invention is also applicable to switching devices used in door open/close systems or other devices. Furthermore, the invention is applicable to switching devices used for purposes other than vehicle equipment.

What is claimed is:

1. A switching device, comprising:

a switch;

a case within which the switch is accommodated;

a cylinder which is provided on an upper surface of the case and open to above and below to communicate with an inside of the case;

an operation knob provided to cover an opening of the cylinder, the operation knob being operable to swing; and an operation bar which extends from the operation knob through the opening of the cylinder into the case to transmit motion of the operation knob to the switch, wherein:

a concave portion is formed on the upper surface of the case in vicinity of the cylinder;

a lid covering a part of the concave portion is provided on the concave portion near the cylinder; and a position of an end of the lid on a side opposite to the cylinder is closer to the cylinder than a position of an end of the operation knob.

2. The switching device according to claim 1, wherein the lid protrudes from the cylinder.

3. A switching device, comprising:

a switch;

a case within which the switch is accommodated;

a cylinder which is provided on an upper surface of the case and open to above and below to communicate with an inside of the case;

an operation knob disposed covering an opening of the cylinder, the operation knob being operable to swing; and an operation bar which extends from the operation knob through the opening of the cylinder into the case to transmit motion of the operation knob to the switch, wherein:

a concave portion is formed on the upper surface of the case proximate to the cylinder;

a lid covering a part of the concave portion is provided on the concave portion near the cylinder; and the lid protrudes from the cylinder.

* * * * *